US007671262B1

(12) United States Patent
Lin

(10) Patent No.: US 7,671,262 B1
(45) Date of Patent: Mar. 2, 2010

(54) ADJUSTING MECHANISM OF AN INSTRUMENT PEDAL

(76) Inventor: Hsi-Tan Lin, No. 43, Longshan 3rd St., Daya Shiang, Taichung County 428 (TW)

( * ) Notice: Subject to any disclaimer, the term of this patent is extended or adjusted under 35 U.S.C. 154(b) by 0 days.

(21) Appl. No.: 12/292,774

(22) Filed: Nov. 26, 2008

(51) Int. Cl.
*G10D 13/02* (2006.01)

(52) U.S. Cl. ..... 84/422.1

(58) Field of Classification Search ..... 84/422.1, 84/422.3, 422.2

See application file for complete search history.

(56) References Cited

U.S. PATENT DOCUMENTS 7,449,626 B2 * 11/2008 Chen ..... 84/422.1

* cited by examiner

*Primary Examiner*—Kimberly R Lockett
(74) *Attorney, Agent, or Firm*—Rosenberg, Klein & Lee

(57) ABSTRACT

This specification discloses an adjusting mechanism of an instrument pedal that is pivotally disposed on a pivotal axis of a base to sway along the radial direction of the pivotal axis. The adjusting mechanism has a foundation. There is an arc surface around the radial direction of the pivotal axis outside the foundation. A sliding groove is formed along the radial direction of the arc surface. A fixed hole is formed on the pivotal axis corresponding to the sliding groove. One end of the fixing element goes through the sliding groove and connects to the fixing hole. The other end of the fixing element engages with the arc surface on both sides of the sliding groove for fixing the adjusting mechanism.

3 Claims, 6 Drawing Sheets

ADJUSTING MECHANISM OF AN INSTRUMENT PEDAL

BACKGROUND OF THE INVENTION

1. Field of Invention

The invention relates to an instrument pedal and, in particular, to an adjusting mechanism that can rapidly and precisely adjust an instrument pedal.

2. Related Art

A usual instrument pedal is shown in FIG. 6. Basically, a pivotal axis 2 is provided on a base 1. The pivotal axis 2 is locked with an adjusting base 3 and a drumstick base 4. One end of the pivotal axis 2 is fastened by a constraining element 5. The lower part of the constraining element 5 is drawn by a spring 6. A pedal (not shown) is provided underneath the base 1. The pedal is connected with the adjusting base 3 via a chain 7, so that the user steps on the pedal to sway the pivotal axis 2. The drumstick 8 on the drumstick base 4 thus hits the drum. For desired tempo, melody, or personal preferences, the user often adjusts the distance between the drumstick 8 and the drum surface, thereby rendering different beat strengths.

The pivotal axis 2 of a conventional instrument pedal has a hexagonal pillar shape. The adjusting base 3 and the drumstick base 4 are mounted on the pivotal axis 2 by a hexagonal through hole 9, respectively. Therefore, to adjust the distance between the drumstick 8 and the drum surface, one has to first loosen the constraining element 5, followed by adjusting the drumstick 8 to a desired position. Since both the adjusting base 3 and the drumstick base 4 are mounted on the pivotal axis 2, the adjustment of the drumstick 8 will make the adjusting base 3 concurrently drive the tilting angle of the pedal. As a result, a person used to a fixed position of the pedal will not be able to keep the tempo and melody. To individually adjust the positions of the pedal and the drumstick 8, the user has to depart the adjusting base 3 and the drumstick base 4 from the pivotal axis 2. Such adjustments are time-consuming and very inconvenient.

SUMMARY OF THE INVENTION

An objective of the invention is to provide an adjusting mechanism of an instrument pedal to rapidly and accurately adjust the position of the pedal or drumstick.

To achieve the above-mentioned objective, the disclosed adjusting mechanism is pivotally mounted on the pivotal axis of a base to sway along the radial direction of the pivotal axis, characterized in that: the adjusting mechanism has a foundation whose outer side has an arc surface around the radial direction of the pivotal axis, the arc surface has a sliding groove along the radial direction of the arc surface, a fixing hole is formed on the pivotal axis corresponding to the sliding groove, a fixing element goes through the sliding groove and connects to the fixing hole with its one end, and the other end of the fixing element and the arc surface on both sides of the sliding groove restrict each other, thereby fixing the adjusting mechanism.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
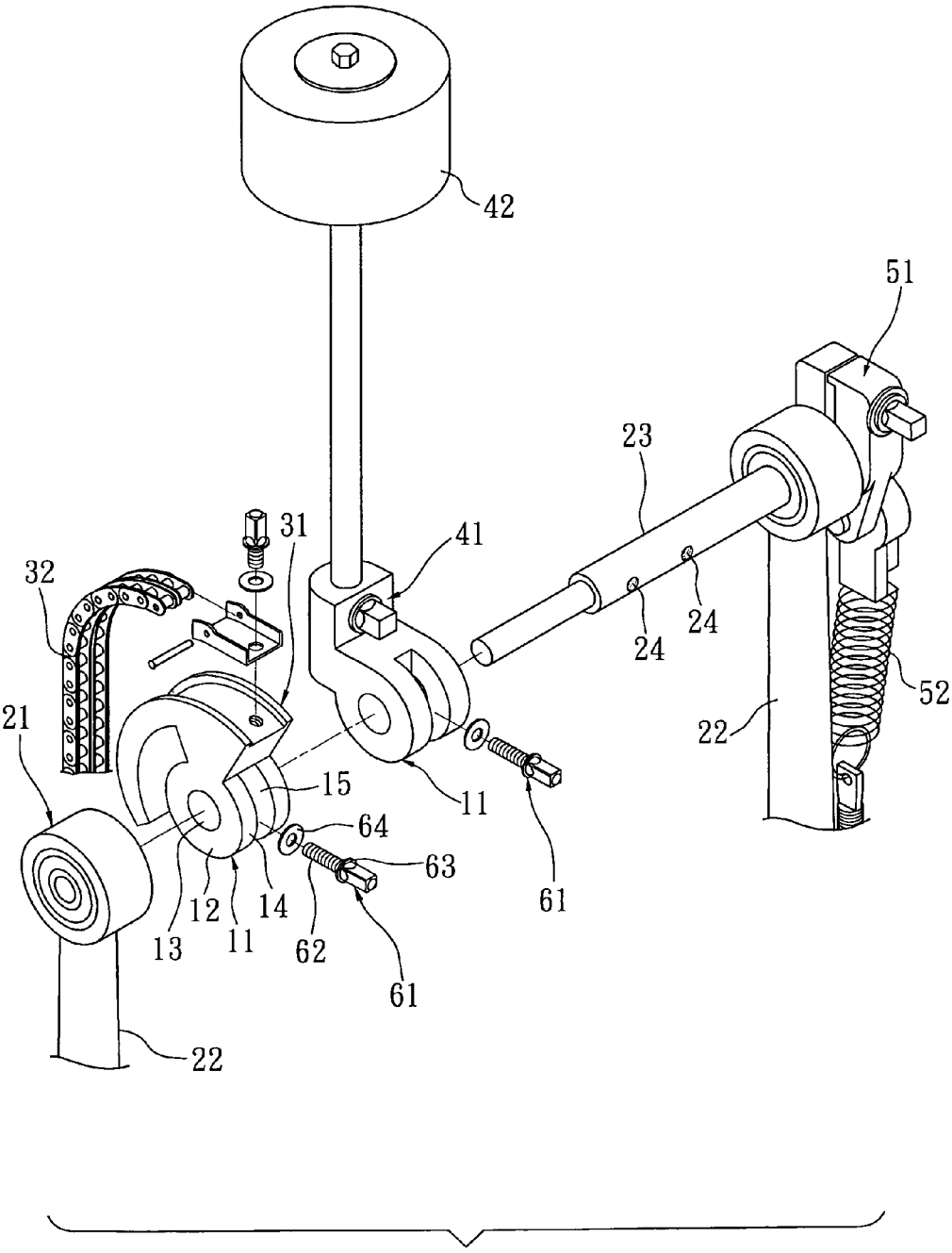
FIG. 1 is a three-dimensional exploded view of the invention.
Figure 2:
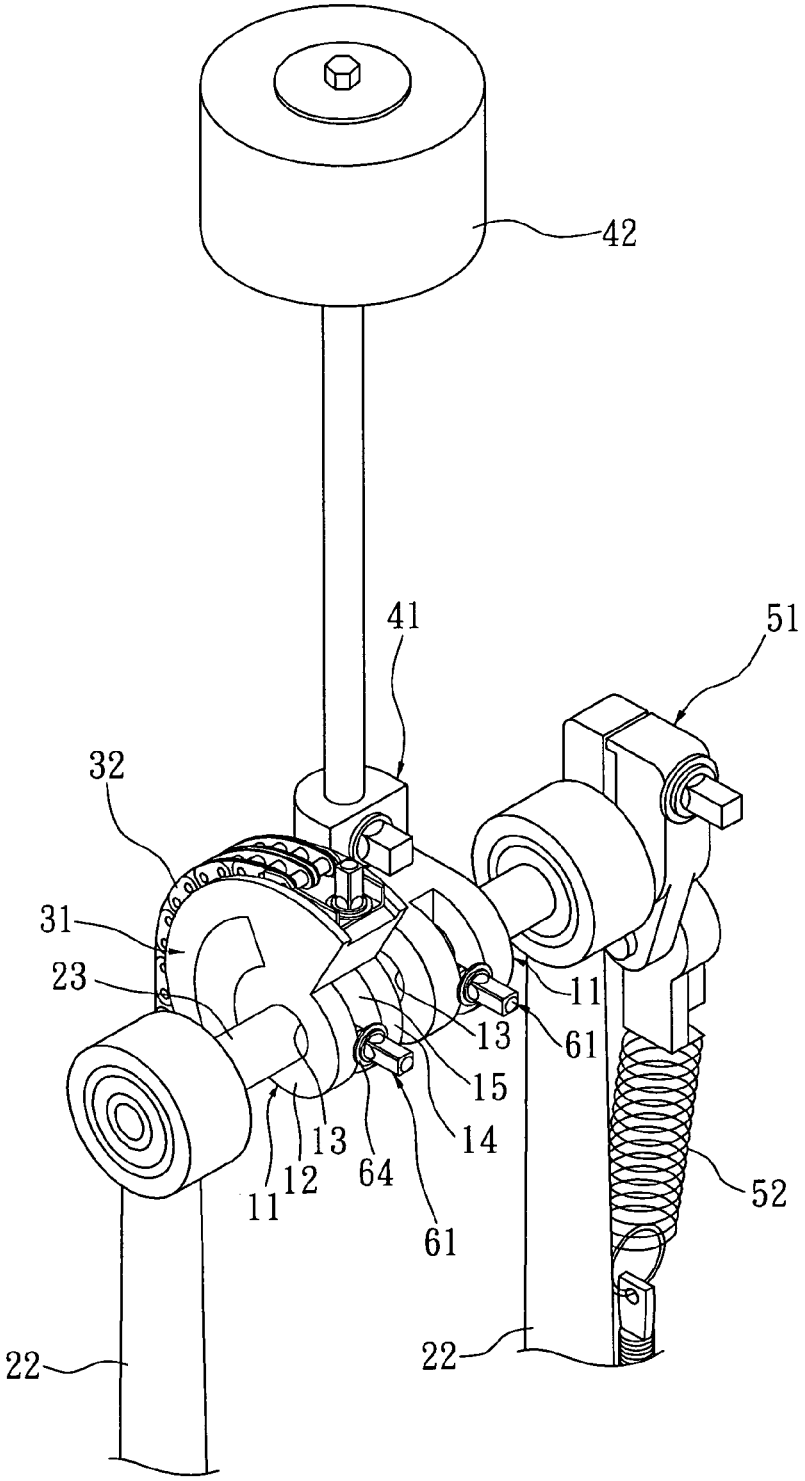
FIG. 2 is three-dimensional assembly view of the invention.
Figure 3:
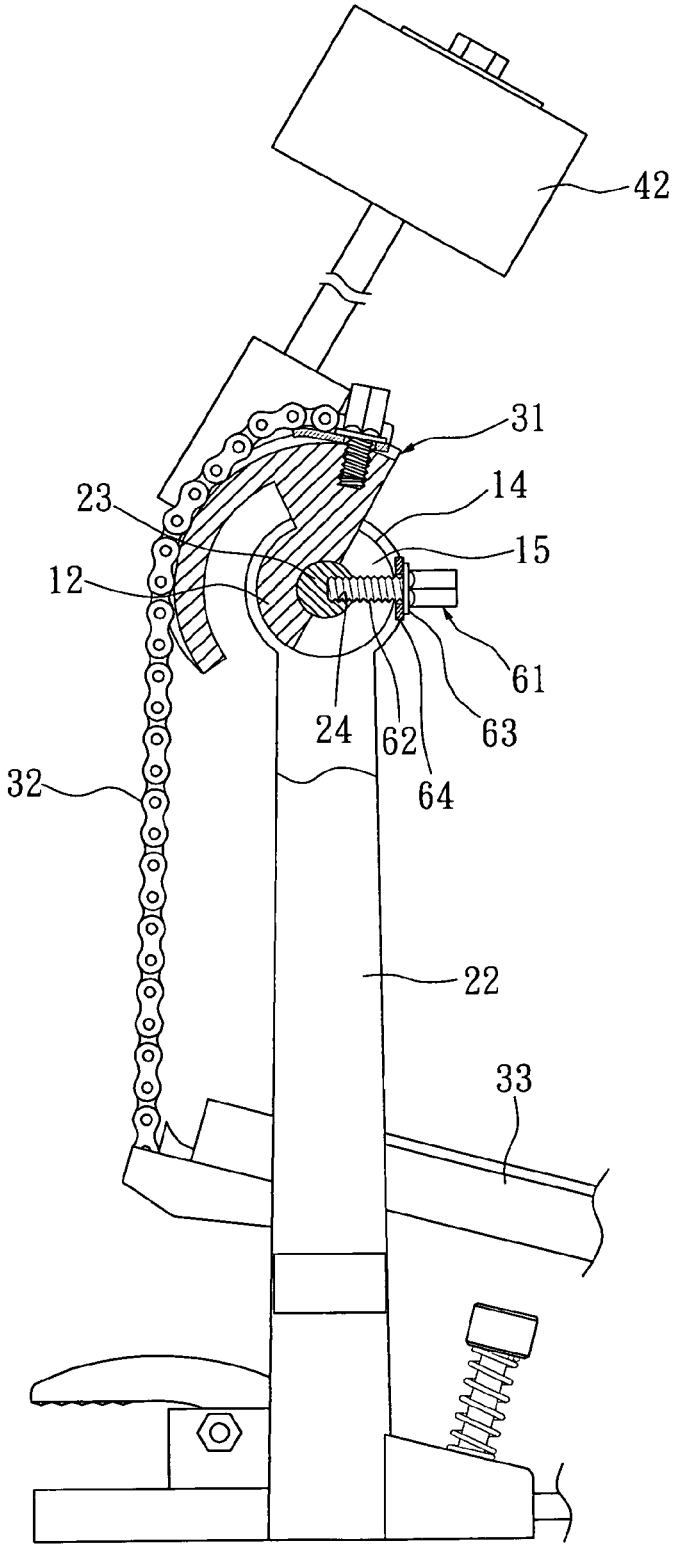
FIG. 3 is a side cross-sectional view of the invention showing the connection between the adjusting base and the pivotal axis.

Please refer to FIG. 1 to FIG. 3. The present invention will be apparent from the following detailed description, which proceeds with reference to the accompanying drawings, wherein the same references relate to the same elements.

The invention provides an adjusting mechanism 11 of an instrument pedal. It is pivotally mounted on an instrument pedal set.

The instrument pedal set has a base 21 that is extended upwards with two arms 22. A pivotal axis 23 strides across the upper edges of the two arms 22. The pivotal axis 23 is further provided with an adjusting base 31, a drumstick base 41, and a constraining element 51. The constraining element 51 is linked to the pivotal axis 23 of the base 21 and drawn by a spring 52. The adjusting base 31 is connected with a pedal 33 via a connecting element 32 (a chain in this embodiment). The drumstick base 41 is connected with a drumstick 42.

In this embodiment, the bottoms of the adjusting base 31 and the drumstick base 41 are provided with the adjusting mechanism 11, respectively. The pivotal axis 23 has a cylindrical shape. As an example, the following paragraph describes the adjusting base 31 with the adjusting mechanism 11.

The adjusting mechanism 11 has a foundation 12. The foundation 12 is formed with a pivotal hole 13 for the pivotal axis 23 to go into, so that the foundation 12 can sway along the radial direction of the pivotal axis 23. The outer side of the foundation 12 is formed with an arc surface 14 around the radial direction of the pivotal axis 23. A sliding groove 15 is formed along the radial direction of the arc surface 14. A fixing hole 24 is formed on the pivotal axis 23 corresponding to the sliding groove 15. One end of a fixing element 61 goes into the sliding groove 15 and connects to the fixing hole 24. The other end of the fixing element 61 and the arc surface 14 on both sides of the sliding groove 15 restrict each other.

In this embodiment, the fixing hole 24 is a screw hole, and one end of the fixing element 61 is formed with a thread section 62 that matches with the fixing hole 24. The other end of the fixing element 61 has a blocking part 63 protruding outwards. The fixing element 61 is further mounted with an expanded pad 64. When the fixing element 61 rotates towards the fixing hole 24, the blocking part 63 of the fixing element 61 presses the pad 64 and urges against the arc surface 14 on both sides of the sliding groove 15, rendering a blocking state. This fixes the position of the adjusting mechanism 11 on the pivotal axis 23.

It should be mentioned that the pivotal axis 23 or the pivotal hole 13 for the pivotal axis 23 in the invention is not limited to the circular shape disclosed above. As long as the shape allows the foundation 12 to sway with respect to the pivotal axis 23, such variations should be considered as equivalent embodiments of the invention.

Figure 4:
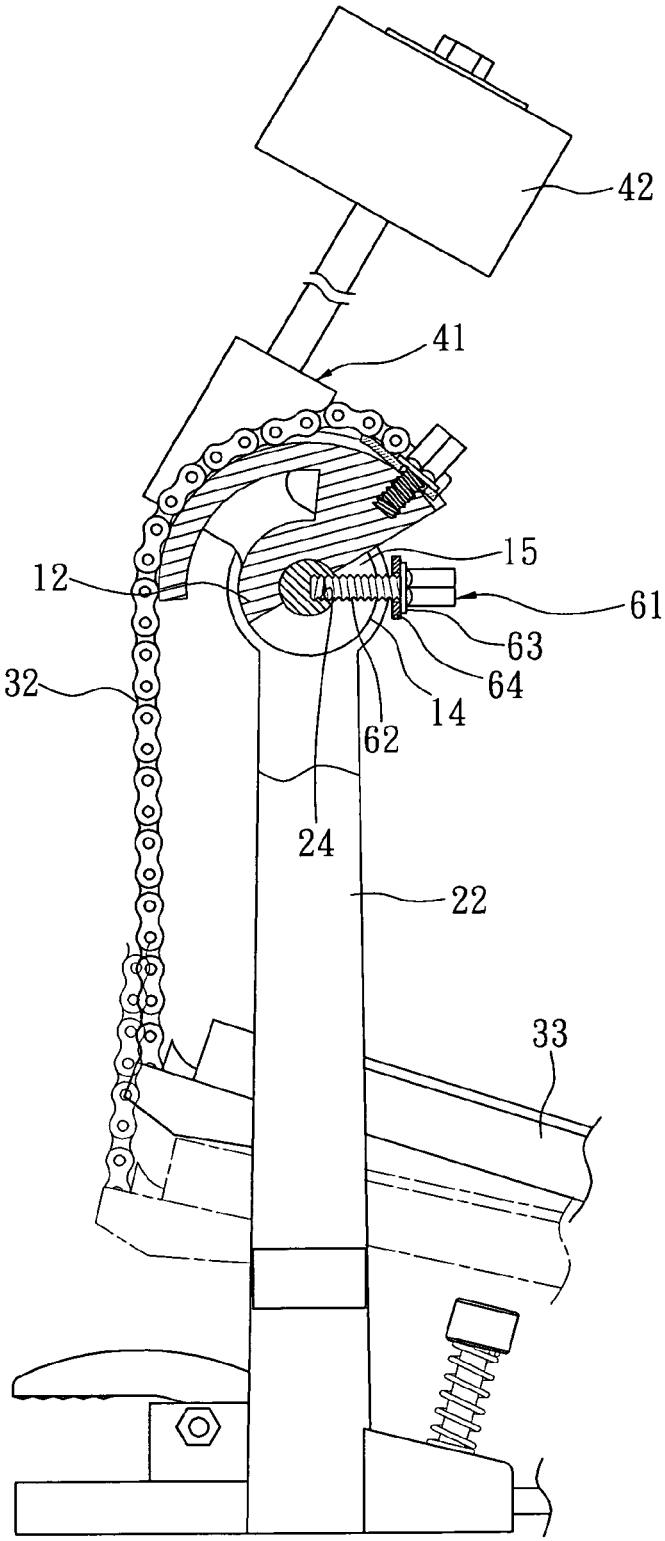
FIG. 4 is a schematic view showing that the foundation can sway as the blocking part of the fixing element and the arc surface on both sides of the sliding groove do not urge against each other.

Please refer to FIG. 4. To adjust the position of the adjusting base 31 on the pivotal axis 23, the user only needs to loosen the fixing element 61 so that the blocking part 63 thereof does not urge against the arc surface on both sides of the sliding groove 15. The user can then directly sway and adjust the adjusting mechanism 11. As the foundation 12 sways, the design of the arc surface 14 of the foundation 12 enables the foundation 12 to conveniently pass by the blocking part 63 of the fixing element 61 without being blocked thereby. Therefore, the invention can smoothly perform adjustments.

Figure 5:
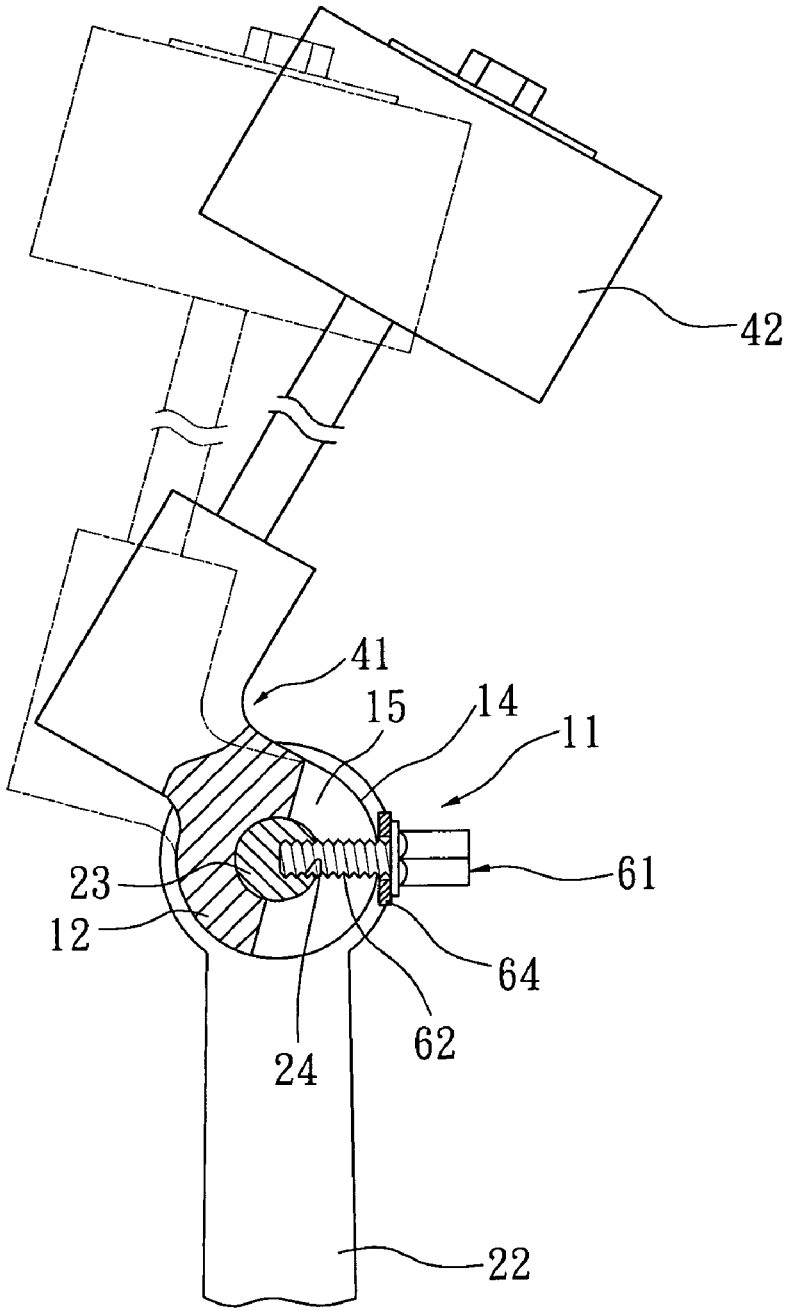
FIG. 5 is a schematic view showing the adjustment of the drumstick base.
Figure 6:
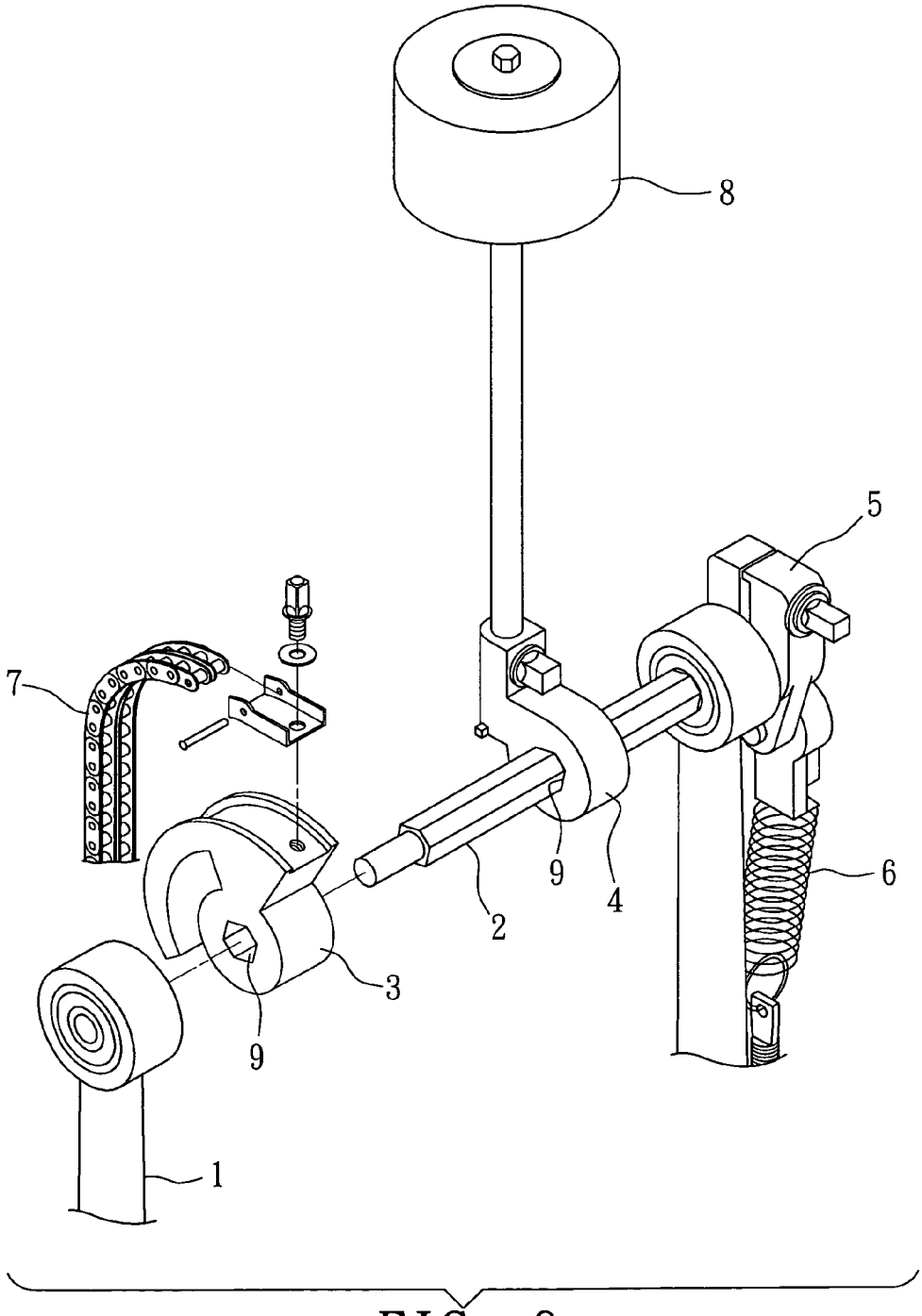
FIG. 6 PRIOR ART
FIG. 6 is a three-dimensional view of the conventional instrument pedal.

Likewise, to adjust the position of the drumstick 42, as shown in FIG. 5, the user only needs to loosen the fixing element 61 of the drumstick base 41. Afterwards, the user can directly sway and adjust the drumstick base 41.

The disclosed adjusting mechanism of an instrument pedal has the following advantages:

1. The disclosed structure is simple and easy to make. Therefore, it can effectively reduce the production cost.

2. The position of the pedal or drumstick can be quickly adjusted by simply fastening or loosening the corresponding fixing element without taking apart the entire device.

3. The adjusting base or drumstick base in the invention can sway with respect to the pivotal axis. Therefore, their positions can be finely adjusted.

4. The adjusting base and the drumstick base can be individually adjusted without interfering with each other. Therefore, the user can make various adjustments according to his or her needs conveniently.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An adjusting mechanism of an instrument pedal, comprising:

a pivotable shaft rotatably supported by a base, the pivotable shaft having at least one fixing hole formed therein;

a drumstick coupled to the pivotable shaft for angular displacement therewith;

a foundation coupled to the pivotable shaft for rotative displacement therewith, the foundation having (a) a pivot hole receiving the pivotable shaft therein, (b) an arc surface formed around a perimeter portion of the foundation, and (c) a radially directed sliding groove formed in the arc surface, the sliding groove being disposed in correspondence with the fixing hole;

a fixing element passing through the sliding groove connects to the fixing hole on one end thereof, an opposing end portion of the fixing element being disposed in contiguous contact with the arc surface on opposing sides of the sliding groove to affix the adjusting mechanism to the pivotable shaft; and an instrument pedal having a distal end coupled to the foundation by a connecting element extending therebetween for rotation of foundation responsive to angular displacement of the instrument pedal to thereby angularly displace the drumstick.

2. The adjusting mechanism of an instrument pedal as in claim 1, wherein the fixing hole is a screw hole, the one end of the fixing element has a thread section formed thereon for threaded engagement with the fixing hole, the opposing end portion of the fixing element having a blocking part formed thereon and protruding outwardly therefrom, the blocking part of the fixing element in contiguous contact with the arc surface on the opposing sides of the sliding groove when the fixing element is engaged with the fixing hole.

3. The adjusting mechanism of an instrument pedal as in claim 2, wherein the foundation is rotatably displaceable relative to the pivotable shaft when the fixing element is at least partially disengaged from the fixing hole and the blocking part is displaced from the arc surface for adjustably angularly positioning the foundation relative to an angular position of the drumstick.

* * * * *